US010934883B2

(12) United States Patent
Dyer et al.

(10) Patent No.: US 10,934,883 B2
(45) Date of Patent: Mar. 2, 2021

(54) COVER FOR AIRFOIL ASSEMBLY FOR A GAS TURBINE ENGINE

(71) Applicant: United Technologies Corporation, Farmington, CT (US)

(72) Inventors: David M. Dyer, Glastonbury, CT (US); Scott Gammons, Higganum, CT (US)

(73) Assignee: RAYTHEON TECHNOLOGIES, Farmington, CT (US)

( * ) Notice: Subject to any disclaimer, the term of this patent is extended or adjusted under 35 U.S.C. 154(b) by 474 days.

(21) Appl. No.: 16/128,948

(22) Filed: Sep. 12, 2018

(65) Prior Publication Data

US 2020/0080443 A1 Mar. 12, 2020

(51) Int. Cl.

| | |
|---|---|
| ***F01D 9/04*** | (2006.01) |
| ***F01D 17/16*** | (2006.01) |
| ***F04D 29/02*** | (2006.01) |
| ***F04D 29/16*** | (2006.01) |
| ***F04D 29/56*** | (2006.01) |

(52) U.S. Cl.

CPC ..... *F01D 17/162* (2013.01); *F01D 9/041* (2013.01); *F04D 29/023* (2013.01); *F04D 29/164* (2013.01); *F04D 29/563* (2013.01); *F05D 2240/12* (2013.01); *F05D 2300/30* (2013.01)

(58) Field of Classification Search

CPC ..... F01D 17/162; F01D 9/041; F04D 29/164; F04D 29/023; F04D 29/563; F05D 2240/12; F05D 2300/30

See application file for complete search history.

(56) References Cited

U.S. PATENT DOCUMENTS

| | | | | | |
|---|---|---|---|---|---|
| 3,442,493 | A | * | 5/1969 | Smith, Jr. | F04D 29/563 415/164 |
| 3,563,669 | A | * | 2/1971 | Hockert et al. | F01D 5/148 415/115 |
| 4,705,452 | A | * | 11/1987 | Karadimas | F01D 17/162 415/115 |
| 4,741,665 | A | | 5/1988 | Hanser | |
| 4,897,020 | A | * | 1/1990 | Tonks | F01D 5/186 415/115 |
| 5,207,558 | A | * | 5/1993 | Hagle | F01D 5/148 415/12 |
| 5,314,301 | A | * | 5/1994 | Knight | F01D 5/148 415/160 |
| 5,520,511 | A | | 5/1996 | Loudet | |

(Continued)

FOREIGN PATENT DOCUMENTS

| | | |
|---|---|---|
| DE | 102016208706 | 11/2017 |
| JP | S5893903 A6 | 6/1983 |

OTHER PUBLICATIONS

EP Search Report for EP Application No. 19196629.0 dated Jan. 20, 2020.

*Primary Examiner* — Aaron R Eastman
*Assistant Examiner* — Theodore C Ribadeneyra
(74) *Attorney, Agent, or Firm* — Carlson, Gaskey & Olds, P.C.

(57) ABSTRACT

A vane assembly includes a fixed airfoil portion that extends between a radially inner platform and radially outer platform and has a pressure side and a suction side. A rotatable airfoil portion is located aft of the fixed airfoil portion and has a pressure side and a suction side. A cover extends from the pressure side of the fixed airfoil portion to the pressure side of the rotatable airfoil portion.

9 Claims, 4 Drawing Sheets

(56) References Cited

U.S. PATENT DOCUMENTS

| | | | | |
|---|---|---|---|---|
| 5,931,636 | A * | 8/1999 | Savage | F01D 17/141 415/115 |
| 6,681,558 | B2 * | 1/2004 | Orlando | F01D 9/041 60/204 |
| 7,452,182 | B2 * | 11/2008 | Vance | F01D 5/14 415/135 |
| 7,553,126 | B2 * | 6/2009 | Charier | F01D 17/14 415/128 |
| 8,052,388 | B2 * | 11/2011 | McCaffrey | F01D 5/145 415/115 |
| 8,202,043 | B2 * | 6/2012 | McCaffrey | F01D 17/162 415/160 |
| 8,668,445 | B2 * | 3/2014 | Crespo | F01D 9/04 415/160 |
| 8,915,703 | B2 * | 12/2014 | Mohammed | F04D 29/563 415/160 |
| 9,533,485 | B2 | 1/2017 | Marshall et al. | |
| 10,012,103 | B2 * | 7/2018 | Pachidis | F01D 25/10 |
| 10,480,326 | B2 * | 11/2019 | Candelori | F01D 5/145 |
| 2016/0130973 | A1 * | 5/2016 | Pachidis | F01D 5/146 415/148 |
| 2016/0341068 | A1 | 11/2016 | Robertson, Jr. et al. | |

* cited by examiner

COVER FOR AIRFOIL ASSEMBLY FOR A GAS TURBINE ENGINE

STATEMENT REGARDING FEDERALLY SPONSORED RESEARCH OR DEVELOPMENT

This invention was made with Government support awarded by the United States. The Government has certain rights in this invention.

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. As the gases pass through the gas turbine engine, they pass over rows of vanes and rotors. In order to improve the operation of the gas turbine engine during different operating conditions, an orientation of some of the vanes and/or rotors may vary to accommodate current conditions.

SUMMARY

In one exemplary embodiment, a vane assembly includes a fixed airfoil portion that extends between a radially inner platform and radially outer platform and has a pressure side and a suction side. A rotatable airfoil portion is located aft of the fixed airfoil portion and has a pressure side and a suction side. A cover extends from the pressure side of the fixed airfoil portion to the pressure side of the rotatable airfoil portion.

In a further embodiment of any of the above, the rotatable airfoil portion is rotatable about an axis that extends through the rotatable airfoil portion.

In a further embodiment of any of the above, the fixed airfoil includes a slot. The cover is at least partially located within the slot.

In a further embodiment of any of the above, the slot extends in a radial direction. The cover includes a tab that extends into the slot.

In a further embodiment of any of the above, the fixed airfoil portion includes a recess for accepting the cover.

In a further embodiment of any of the above, the cover is made of a flexible silicon material.

In a further embodiment of any of the above, the cover includes a first side that faces in the same direction as the pressure side on the fixed airfoil portion. A second side is opposite the first side in abutting contact with the recess.

In a further embodiment of any of the above, a trailing edge of the fixed airfoil portion includes a concave surface. A leading edge of the rotatable airfoil portion is convex and follows a profile of the trailing edge of the fixed airfoil portion.

In another exemplary embodiment, a gas turbine engine includes a compressor section driven by a turbine section. The compressor section includes a vane assembly that has a fixed airfoil portion that extends between a radially inner platform and radially outer platform that has a pressure side and a suction side. A rotatable airfoil portion is located aft of the fixed airfoil portion and has a pressure side and a suction side. A cover extends from the pressure side of the fixed airfoil portion to the pressure side of the rotatable airfoil portion.

In a further embodiment of any of the above, the rotatable airfoil portion is rotatable about an axis that extends through the rotatable airfoil portion.

In a further embodiment of any of the above, the fixed airfoil includes a slot and the cover is at least partially located within the slot.

In a further embodiment of any of the above, the slot extends in a radial direction and the cover includes a tab that extends into the slot.

In a further embodiment of any of the above, the fixed airfoil portion includes a recess for accepting the cover.

In a further embodiment of any of the above, the cover is made of a flexible silicon material.

In a further embodiment of any of the above, the cover includes a first side facing in the same direction as the pressure side on the fixed airfoil portion. A second side is opposite the first side and is in abutting contact with the recess.

In a further embodiment of any of the above, a trailing edge of the fixed airfoil portion includes a concave surface. A leading edge of the rotatable airfoil portion is convex and follows a profile of the trailing edge of the fixed airfoil portion.

In another exemplary embodiment, a method of operating a variable vane assembly includes the step of rotating a rotatable airfoil portion relative to a fixed airfoil portion and flexing a cover in response to the relative movement of the rotatable airfoil portion relative to the fixed airfoil portion. The cover extends axially from a pressure side of the fixed airfoil portion to a pressure side of the rotatable airfoil portion.

In a further embodiment of any of the above, the rotatable airfoil portion is rotatable about an axis that extends through the rotatable airfoil portion. The fixed airfoil includes a slot and the cover is at least partially located within the slot.

In a further embodiment of any of the above, the slot extends in a radial direction and the cover includes a tab that extends into the slot.

In a further embodiment of any of the above, the cover includes a first side facing in the same direction as the pressure side on the fixed airfoil portion, A second side is opposite the first side and is in abutting contact with the fixed airfoil portion.

DETAILED DESCRIPTION

Figure 1:
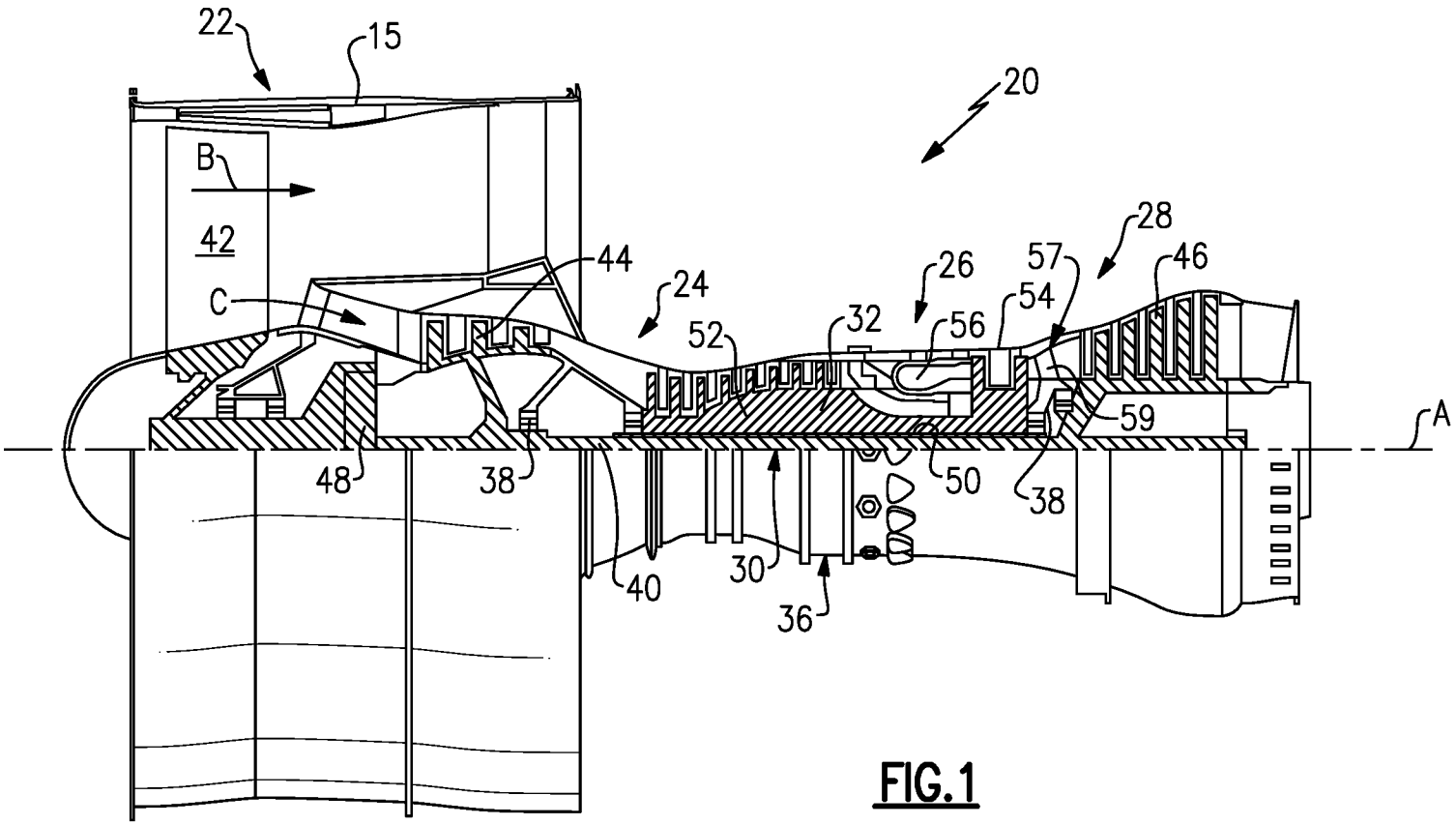
FIG. 1 is a schematic view of an example gas turbine engine according to a first non-limiting embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core airflow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]0.5. The "Low corrected fan tip speed" as disclosed herein according to one non-limiting embodiment is less than about 1150 ft/second (350.5 meters/second).

Figure 2:
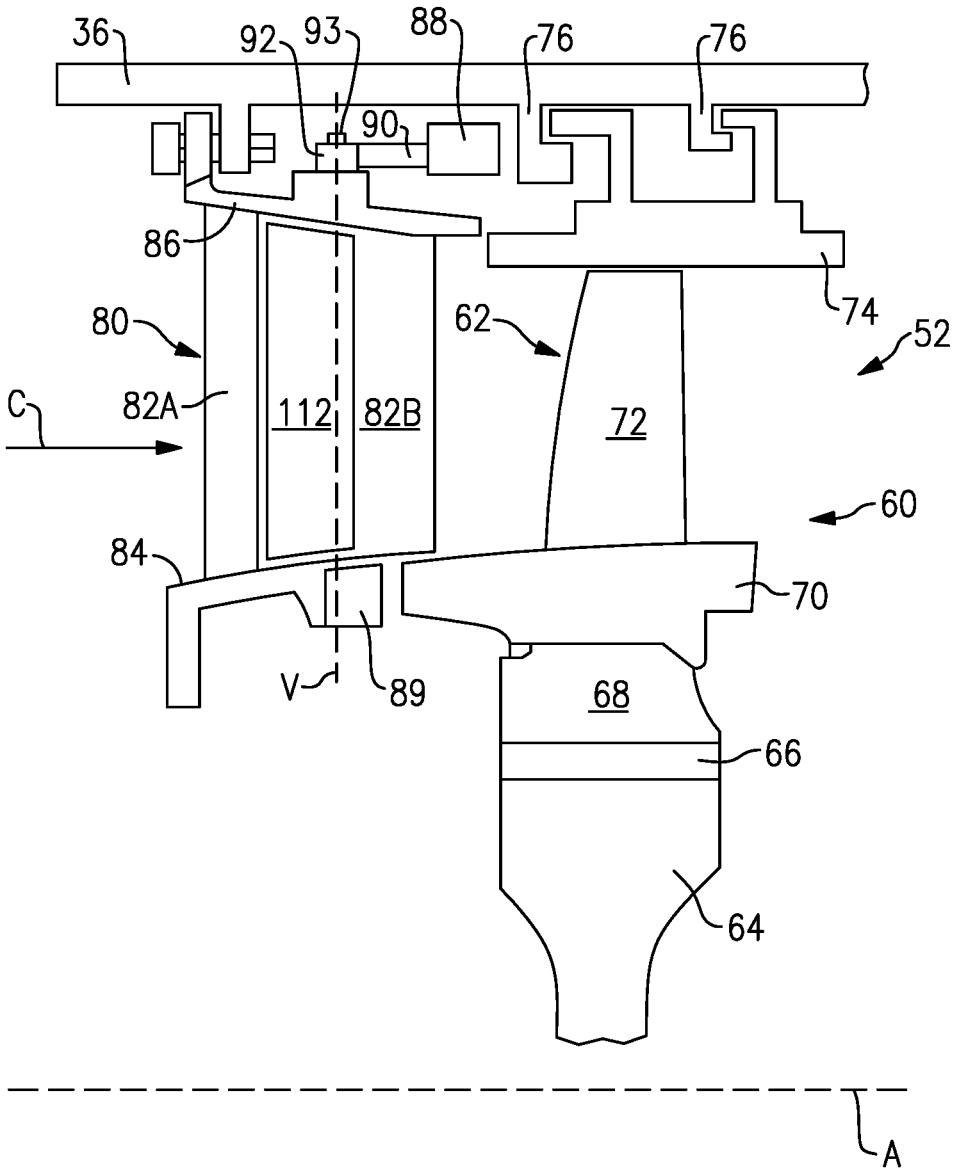
FIG. 2 is a schematic view of a portion of a compressor section.

FIG. 2 illustrates an enlarged schematic view of the high pressure compressor 52, however, other sections of the gas turbine engine 20 could benefit from this disclosure, such as the fan section 22 or the turbine section 28. In the illustrated example, the high pressure compressor 52 includes multiple stages (See FIG. 1). However, the illustrated example in FIG. 2 only shows a single stage of the high pressure compressor 52 and a first rotor assembly 60.

The first rotor assembly 60 includes a plurality of first rotor blades 62 circumferentially spaced around a first disk 64 to form an array. Each of the plurality of first rotor blades 62 include a first root portion 68, a first platform 70, and a first airfoil 72. Each of the first root portions 68 are received within a respective first rim 66 of the first disk 64. The first airfoil 72 extends radially outward toward a blade outer air seal (BOAS) 74. The BOAS 74 is attached to the engine static structure 36 by retention hooks 76 on the engine static structure 36. The plurality of first rotor blades 62 are disposed in the core flow path C. The first platform 70 separates a gas path side inclusive of the first airfoils 72 and a non-gas path side inclusive of the first root portion 68.

Figure 4:
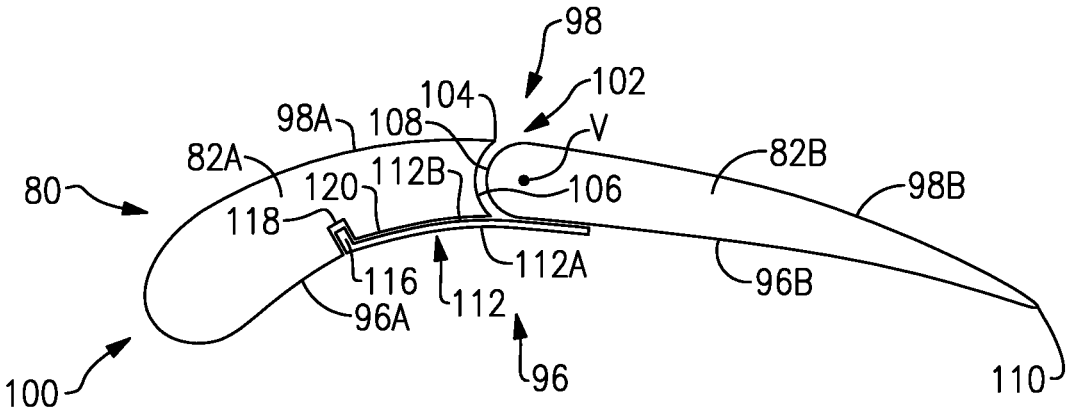
FIG. 4 is a cross-sectional view along line 4-4 of FIG. 3.

A plurality of vanes 80 are located axially upstream of the plurality of first rotor blades 62. Each of the plurality of vanes 80 includes a fixed airfoil portion 82A and a rotatable or variable airfoil portion 82B. The fixed airfoil portion 82A is immediately upstream of the rotatable airfoil portion 82B such that the fixed airfoil portion 82A and the rotatable airfoil portion 82B form a single vane 80 of the plurality of vanes 80. The rotatable airfoil portion 82B rotates about an axis V as shown in FIGS. 2 and 4.

A radially inner platform 84 and a radially outer platform 86 extend axially along radially inner and outer edges of each of the vanes 80, respectively. In the illustrated example, the radially outer platform 86 extends along the entire axial length of the fixed airfoil portion 82A and the rotatable airfoil portion 82B and the radially inner platform 84 extends along the entire axial length of the fixed airfoil portion 82A and along only a portion of the axial length of the rotatable airfoil portion 82B. Also, the rotatable airfoil portion 82B moves independently of the radially inner platform 84 and the radially outer platform 86. In this disclosure axial or axially, radial or radially, and circumferential or circumferentially is in relation to the engine axis A unless stated otherwise.

A variable pitch driver 88 is attached to a radially outer projection 92 on a radially outer end of the rotatable airfoil portion 82B through an armature 90. The radially outer projection 92 includes a cylindrical cross section. The armature 90 rotates the radially outer projection 92 about the axis V to position the rotatable airfoil portion 82B about the axis V. The variable pitch driver 88 include at least one actuator that cause movement of the armature 90 to rotate the radially outer projection 92 and cause the rotatable airfoil portion 82B to rotate.

Figure 3:
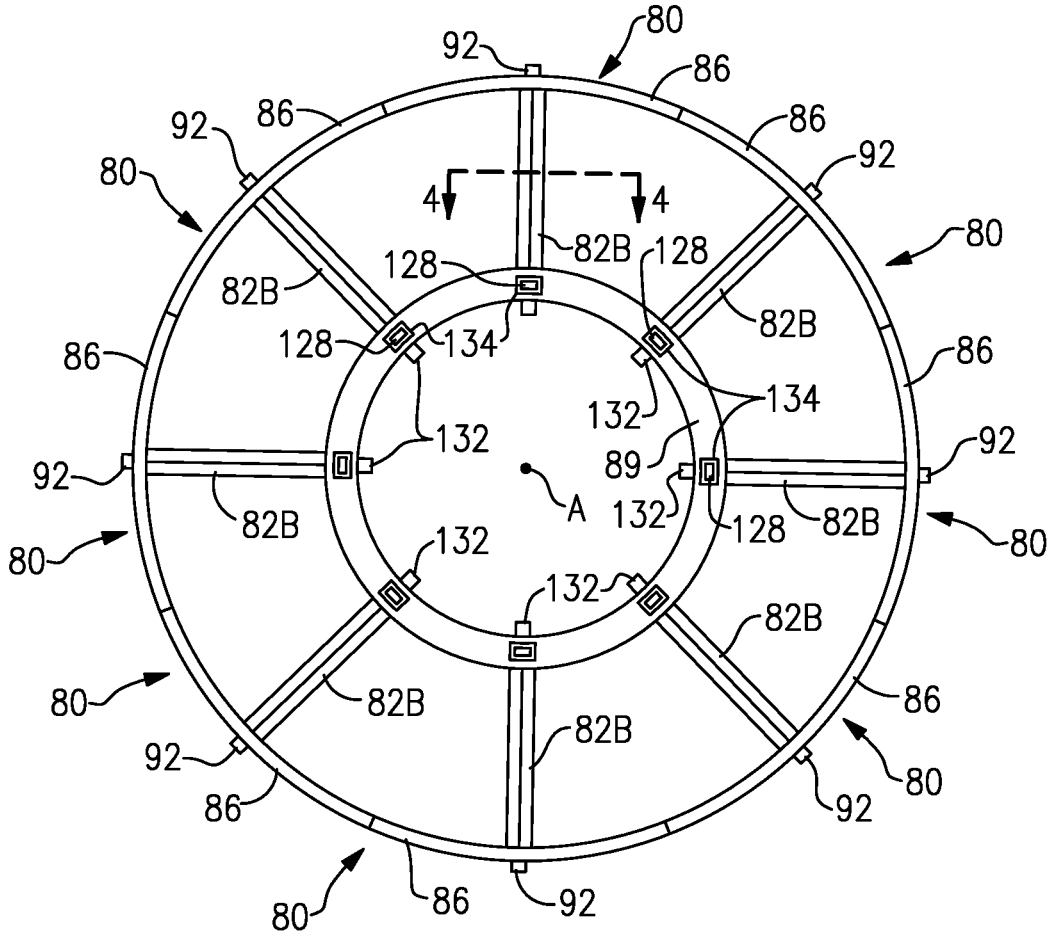
FIG. 3 is an axially forward facing view of a plurality of vanes.

As shown in FIGS. 2 and 3, the plurality of vanes 80 are circumferentially spaced around the engine axis A. The rotatable airfoil portion 82B is at least partially secured by a retention clamshell 89 located on a radially inner side of each of the plurality of vanes 80 and a pivotable connection formed between the radially outer projection 92 and an opening 94 (see FIG. 5) through the radially outer platform 86.

As shown in FIG. 4, the vane 80 includes a pressure side 96 and a suction side 98. The fixed airfoil portion 82A includes a pressure side portion 96A and a suction side portion 98A. Similarly, the rotatable airfoil portion 82B includes a pressure side portion 96B and a suction side portion 98B. The pressure side portions 96A, 96B collectively form the pressure side 96 of the vane 80 and the suction side portions 98A, 98B collectively form the suction side 98 of the vane 80.

The fixed airfoil portion 82A includes a leading edge 100 and a trailing edge 102. The trailing edge 102 includes edges 104 at the pressure side portion 96A and the suction side portion 98A that are connected by a concave surface 106. The rotatable airfoil portion 82B also includes a leading edge 108 and a trailing edge 110. The leading edge 108 of the rotatable airfoil portion 82B includes a curved profile that follows a curved profile of the concave surface 106 on the trailing edge 102 of the fixed airfoil portion 82A.

Figure 5:
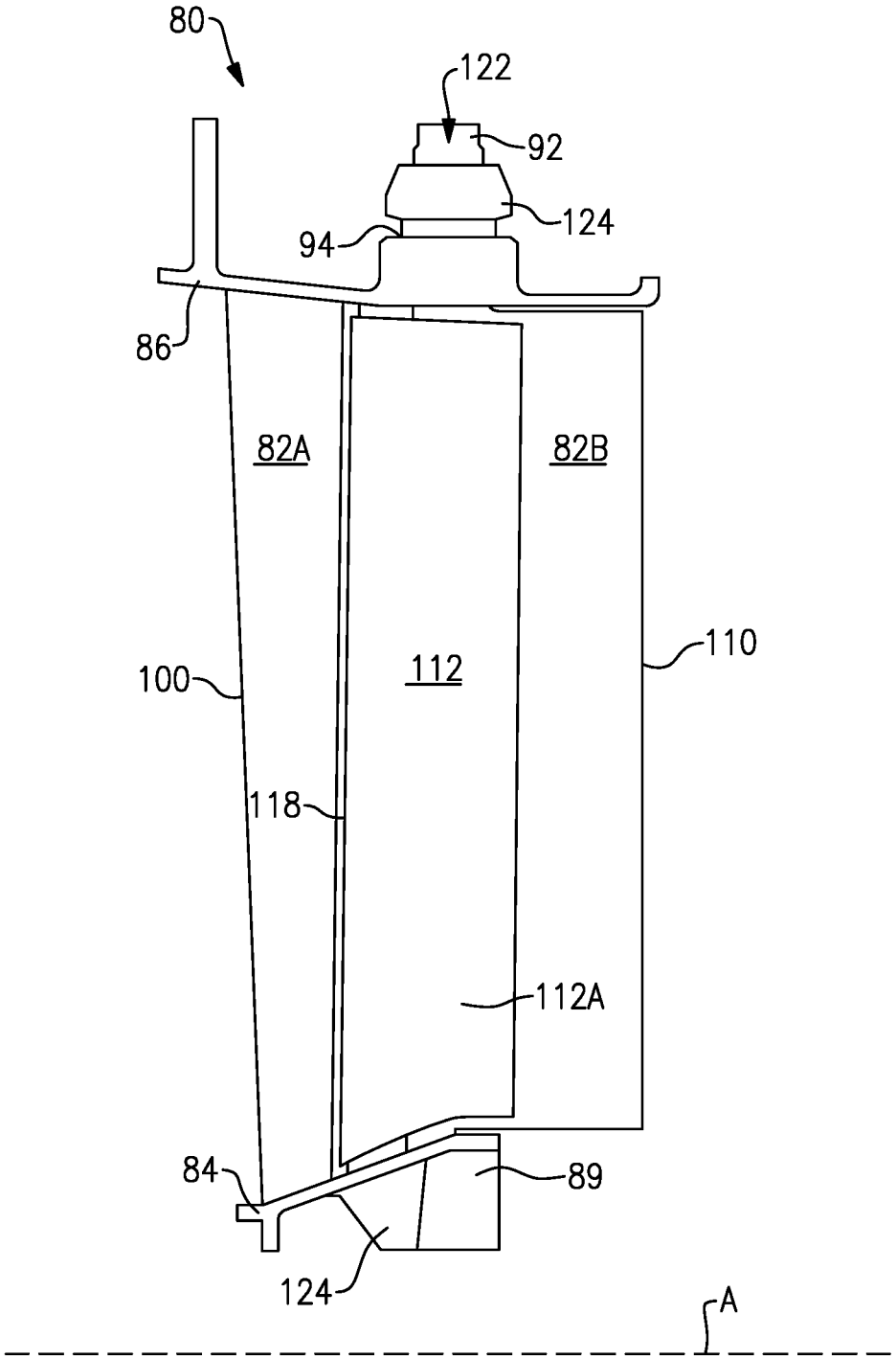
FIG. 5 is an enlarged schematic view of a vane.

As shown in FIG. 5, the radially outer platform 86 includes the opening 94 for accepting the projection 92 on the rotatable airfoil portion 82B. In the illustrated example, a bushing 124 at least partially spaces the rotatable airfoil portion 82B from the radially outer platform 86 and reduces gases from the core airflow from traveling through the radially outer platform 86. The projection 92 also includes a fastener opening 122 for accepting a fastener 93 (FIG. 2) for securing the armature 90 (FIG. 2) to the rotatable airfoil portion 82B.

The retention clamshell 89 secures the rotatable airfoil portion 82B to the radially inner platform 84. The radially inner platform 84 includes a protrusion 124 that extends radially inward to support the rotatable airfoil portion 82B and mate with the retention clamshell.

As shown in FIGS. 2, 4, and 5, a flexible cover 112 is located on the pressure side 96 of the vane 80. The flexible cover 112 extends axially from the fixed airfoil portion 82A to the rotatable airfoil portion 82B. The flexible cover 112 includes a first side 112A that faces in the same direction as the pressure side 96 and a second side 112B that faces toward the pressure side 96. An axially forward edge of the flexible cover 112 includes a tab 116 that extends into a slot 118 on the pressure side portion 96A of the fixed airfoil portion 82A. The tab 116 on the flexible cover 112 may be secured to the slot 118 in the fixed airfoil portion 82A with an adhesive, such as a high temperature adhesive. The tab 116 is transverse or perpendicular to at least one of the first and second sides 112A and 112B of the flexible cover 112 and the tab 116 is a unitary single piece with the rest of the flexible cover 112.

The pressure side portion 96A of the fixed airfoil portion 82A may include a recessed area 120 that allows the second side 112B on the flexible cover 112 to sit flush and in abutment with the pressure side portion 96A of the fixed airfoil portion 82A. By allowing the flexible cover 112 to sit flush against the pressure side portion 96A and not protrude past a leading edge portion of the pressure side portion 96A, disruption in the core airflow C traveling over the flexible cover 112 will be reduced.

By extending between the fixed airfoil portion 82A to the rotatable airfoil portion 82B, the flexible cover 112 prevents or reduces air from leaking between the pressure side 96 and the suction side 98. In the illustrated example, the flexible cover 112 extends radially between the radially inner platform 84 and the radially outer platform 86. See FIG. 2. The flexible cover 112 also extends downstream beyond the axis of rotation V of the rotatable airfoil portion 82B. To allow the flexible cover 112 to conform to the varying positions of the rotatable airfoil portion 82B and the fixed airfoil portion 82A, the flexible cover 112 is made of a silicone material, such as a high temperature silicone material, to withstand the temperatures of the core airflow.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A vane assembly comprising:

a fixed airfoil portion extending between a radially inner platform and a radially outer platform, the fixed airfoil portion having a pressure side, a suction side, a slot extending in a radical direction, and recess;

a rotatable airfoil portion aft of the fixed airfoil portion having a pressure side and a suction side and is rotatable about an axis that extends through the rotatable airfoil portion; and a cover extending from the pressure side of the fixed airfoil portion to the pressure side of the rotatable airfoil portion, wherein a tab on the cover is at least partially located within the slot and the cover is accepted in the recess.

2. The vane assembly of claim 1, wherein the cover is made of a flexible silicon material.

3. The vane assembly claim 1, wherein the cover includes a first side facing in the same direction as the pressure side on the fixed airfoil portion and a second side opposite the first side in abutting contact with the recess.

4. The vane assembly of claim 1, wherein a trailing edge of the fixed airfoil portion includes a concave surface and a leading edge of the rotatable airfoil portion is convex and follows a profile of the trailing edge of the fixed airfoil portion.

5. A gas turbine engine comprising:

a compressor section driven by a turbine section, wherein the compressor section includes a vane assembly having:

a fixed airfoil portion extending between a radially inner platform and a radially outer platform, the fixed airfoil portion having a pressure side, a suction side, a slot extending in a radical direction, and a recess;

a rotatable airfoil portion aft of the fixed airfoil portion having a pressure side and a suction side and is rotatable about an axis that extends through the rotatable airfoil portion; and a cover extending from the pressure side of the fixed airfoil portion to the pressure side of the rotatable airfoil portion, wherein a tab on the cover is at least partially located within the slot and the cover is accepted in the recess.

6. The gas turbine engine claim 5, wherein the cover is made of a flexible silicon material.

7. The gas turbine engine of claim 5, wherein the cover includes a first side facing in the same direction as the pressure side on the fixed airfoil portion and a second side opposite the first side in abutting contact with the recess.

8. The gas turbine engine of claim 5, wherein a trailing edge of the fixed airfoil portion includes a concave surface and a leading edge of the rotatable airfoil portion is convex and follows a profile of the trailing edge of the fixed airfoil portion.

9. A method of operating a variable vane assembly comprising the steps of:

rotating a rotatable airfoil portion relative to a fixed airfoil portion, wherein the rotatable airfoil portion is rotatable about an axis that extends through the rotatable airfoil portion and the fixed airfoil includes a slot extending in a radial direction;

flexing a cover in response to the relative movement of the rotatable airfoil portion relative to the fixed airfoil portion, wherein the cover extends axially from a pressure side of the fixed airfoil portion to a pressure side of the rotatable airfoil portion, wherein the cover includes a first side facing in the same direction as the pressure side on the fixed airfoil portion, a second side opposite the first side in abutting contact with the fixed airfoil portion, and a tab that extends into the slot.

* * * * *